US009722316B2

(12) United States Patent
Haziza

(10) Patent No.: US 9,722,316 B2
(45) Date of Patent: Aug. 1, 2017

(54) HORN LENS ANTENNA

(71) Applicant: Google Inc., Mountain View, CA (US)

(72) Inventor: Dedi David Haziza, Cupertino, CA (US)

(73) Assignee: Google Inc., Mountain View, CA (US)

( * ) Notice: Subject to any disclaimer, the term of this patent is extended or adjusted under 35 U.S.C. 154(b) by 276 days.

(21) Appl. No.: 14/324,431

(22) Filed: Jul. 7, 2014

(65) Prior Publication Data

US 2016/0006129 A1 Jan. 7, 2016

(51) Int. Cl.

*H01Q 13/02* (2006.01)
*H01Q 19/08* (2006.01)
*H01Q 19/09* (2006.01)

(52) U.S. Cl.

CPC ..... *H01Q 13/02* (2013.01); *H01Q 13/0283* (2013.01); *H01Q 19/08* (2013.01); *H01Q 19/09* (2013.01)

(58) Field of Classification Search

CPC ..... H01Q 19/06; H01Q 19/062; H01Q 19/08; H01Q 15/02; H01Q 15/08; H01Q 15/10; H01Q 13/02–13/065

USPC ..... 343/753, 783, 785, 909, 911 R

See application file for complete search history.

(56) References Cited

U.S. PATENT DOCUMENTS 2,316,151 A * 4/1943 Barrow ..... H01Q 13/02 333/24 R
2,415,352 A * 2/1947 Iams ..... H01Q 15/02 333/248
3,000,834 A * 9/1961 Aven ..... H05B 33/145 252/301.6 S
5,034,750 A 7/1991 Cardiasmenos
5,515,009 A 5/1996 Wong et al.
5,706,017 A 1/1998 Buttgenbach
5,905,457 A * 5/1999 Rashid ..... G01S 13/931 342/70
6,313,802 B1 11/2001 Petersson
(Continued)

FOREIGN PATENT DOCUMENTS

JP 2001053538 A 2/2001
WO WO-0250954 A2 6/2002

OTHER PUBLICATIONS

Zhijia Liu et al, A Dielectric Lens Antenna Design by Using the Effective Medium Theories, Dec. 8, 2010, University of Electronic Science and Technology China, p. 2.*

(Continued)

*Primary Examiner* — Jessica Han
*Assistant Examiner* — Patrick Holecek
(74) *Attorney, Agent, or Firm* — Honigman Miller Schwartz and Cohn LLP

(57) ABSTRACT

An antenna includes a receiver, a horn, a lens, and an anti-reflection layer. The horn has a first end disposed on the receiver and a second end defining an aperture positioned opposite the receiver. The lens is disposed within the aperture of the horn and has a first surface facing inward toward the receiver and a second surface opposite the first surface and facing outward away from the horn. The anti-reflection layer includes a dielectric material and is disposed on the first surface of the lens. Moreover, the anti-reflection layer defines holes arranged in a 50/50 material to void ratio and that have a thickness of a quarter wavelength of a signal received by the antenna.

16 Claims, 9 Drawing Sheets

(56) References Cited

U.S. PATENT DOCUMENTS

| | | | | |
|---|---|---|---|---|
| 6,950,073 | B2 * | 9/2005 | Clymer | H01P 1/161 342/368 |
| 7,541,994 | B2 * | 6/2009 | Marshall | G01R 29/105 343/703 |
| 7,583,074 | B1 | 9/2009 | Lynch et al. | |
| 7,656,345 | B2 | 2/2010 | Paschen et al. | |
| 7,795,859 | B1 | 9/2010 | Lynch et al. | |
| 7,861,600 | B2 | 1/2011 | Mayer et al. | |
| 8,068,053 | B1 | 11/2011 | Stutzke et al. | |
| 8,536,533 | B2 | 9/2013 | Hobden et al. | |
| 2013/0076851 | A1 | 3/2013 | Watanabe et al. | |
| 2013/0293436 | A1 | 11/2013 | Blech | |

OTHER PUBLICATIONS

International Search Report for PCT Application No. PCT/US2015/031108 dated Jul. 29, 2015.

* cited by examiner

HORN LENS ANTENNA

TECHNICAL FIELD

This disclosure relates to horn lens antennas.

BACKGROUND

Horn antennas, also known as microwave horns, include a flaring metal waveguide shaped like horn that directs radio waves in a beam. Horn antennas have multiple uses, including small-aperture antennas to feed reflectors to large-aperture antennas used by themselves as medium-gain antennas.

The performance of horn antennas is based on the shape and size of the horn. When designing the horn antenna, other considerations are taken into account, such as the fluctuation in temperature, humidity, dust and impurities in the surrounding air and other related factors. These factors affect the propagation of the signals. Therefore, to achieve a better signal, the antenna is designed to provide high gain. High gain generally implies that the antenna size is large. In some examples, size requirements prevent designing the antenna according to the needed size to achieve the required gain. In such instances, other adjustments to the design are considered.

SUMMARY

One aspect of the disclosure provides an antenna that includes a receiver, a horn, a lens, and an anti-reflection layer. The horn has a first end disposed on the receiver and a second end defining an aperture positioned opposite the receiver. The lens is disposed within the aperture of the horn and has a first surface facing inward toward the receiver and a second surface opposite the first surface and facing outward away from the horn. The anti-reflection layer includes a dielectric material and is disposed on the first surface of the lens. Moreover, the anti-reflection layer defines holes arranged in a 50/50 material to void ratio and that have a thickness of a quarter wavelength of a signal received by the antenna.

Another aspect of the disclosure provides a method of making a horn antenna, the method includes: forming a lens having a first surface and a second surface opposite the first surface; forming an anti-reflection layer having a dielectric material; disposing the anti-reflection layer on the first surface of the lens; and positioning the lens within an aperture defined by a horn. The anti-reflection layer defines holes arranged in a 50/50 material to void ratio and has a thickness of a quarter wavelength of a signal received by the antenna. The horn has first and second ends, where the first end receives a receiver and the second end defines the aperture. The lens is positioned so that the first surface of the lens faces the receiver.

Implementations of the disclosure may include one or more of the following features. In some implementations, the horn defines a frustoconical shape, a pyramidal shape, an h-plane sectoral shape, or an E-shape sectoral shape. The anti-reflection layer may be integral with the lens. In such cases, the lens defines the holes in its first surface facing the receiver, where the holes have a depth equal to the thickness of the anti-reflection layer. Moreover, the holes may have a diameter of less than or equal to a tenth of the wavelength of the signal received by the antenna. In some examples, the lens and the anti-reflection layer is a cross linked polysterene microwave plastic or a Polytetrafluoroethylene. Other materials are possible as well. The second end of the horn may define a groove configured to receive the lens. The horn may define a frustoconical shape having a flare angle of about 45 degrees.

In some examples, the holes of the anti-reflection layer have one or more of a circular cross-sectional shape, a square cross-sectional shape, a diamond cross-sectional shape, an oval cross-sectional shape, or a rectangular cross-sectional shape. The holes may be arranged in a two-dimensional array.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1A:
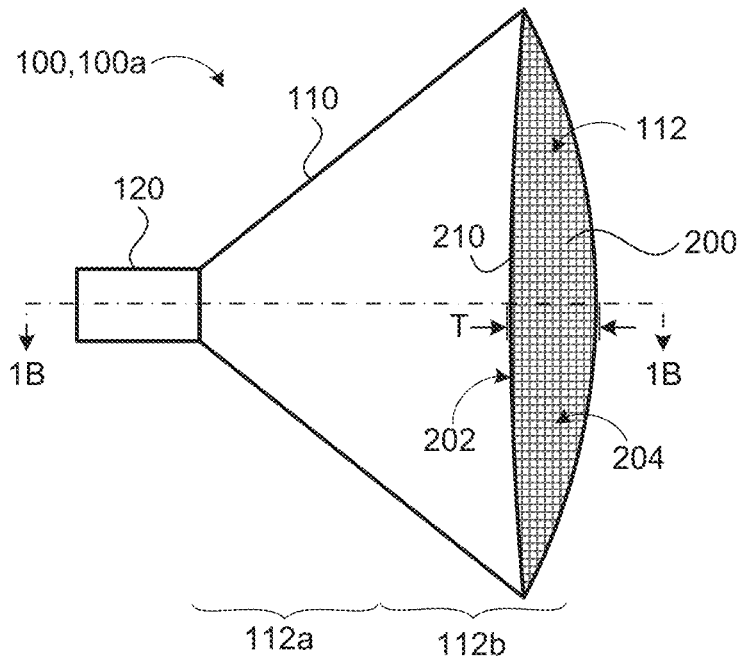
FIG. 1A is a schematic views of an exemplary horn antenna.

A horn antenna gradually transitions waves from a tube into space allowing the impedance of the tube to match the impedance of free space. Referring to FIGS. 1A-1G, in some implementations, a horn antenna 100 (e.g., a wide-band horn antenna) includes a horn 110, a receiver 120, a lens 200, and an anti-reflection layer 210 disposed on the lens 200. In the example of the horn antenna 100*a* shown in FIGS. 1A-1D, the horn 110 defines a frustoconical shape (i.e., having the shape of a frustum of a cone) or a surface of revolution (i.e., a surface formed when a curve is revolved around an axis) having an axial length L along a center axis 111 and an aperture 112 having a flare angle θ and a width W. Conical horn antennas 100*a* have a circular cross section and are used with cylindrical waveguides. Other types of horns 110 are possible a well, such as a pyramidal horn 100*b* (FIG. 1D), an H-plane sectoral horn 100*c* (FIG. 1E), an E-plane sectoral horn 100*d* (FIG. 1F), etc.

The horn 110 may be flared at a constant flare angle θ or exponentially. The pyramidal horn 100*b* defines a four-sided pyramid (sides S1, S2, S3, S4) having a rectangular cross section where the parallel sides S1 and S3 have a greater length than the other parallel sides S2 and S4. All sides of the pyramidal horn 100*b* are flared. The pyramidal horn 100*b* is used with rectangular waveguides and radiates linearly polarized radio waves. The sectoral horn 100*c*, 100*d* (including the H-plane sectoral horn 100*c* and the E-plane sectoral horn 100*d*) has a pyramidal horn shape with four sides S1-S4; however, only one pair of the sides is flared while the other pair is parallel. Sectoral horns 100*c*, 100*d* are generally used as feed horns for wide search radar antennas. As shown in FIG. 1F, the H-plane sectoral horn 100*c* has parallel sides S1 and S3 and flared out sides S2 and S4. As shown in FIG. 1G, the E-plane sectoral horn 100*c* has flared out sides S1 and S3 and parallel sides S2 and S4. Thus, the difference between the H-plane horn 100*c* and the E-plane horn 100*d* is that the H-plane horn 100*c* has the pair of opposite flared sides S2, S4 in the direction of the magnetic or H-field H of the waveguide; while the E-plane horn 100*d* has the pair of opposite flared sides S1, S3 in the direction of the electric or E-field E in the waveguide.

Referring back to FIGS. 1A-1G, in some examples, the horn antenna 100 may include ridges or fins (not shown) disposed on an inner surface 110*a* of the horn 110. The ridges or fin may extend through the inner surface 110*a* from a first end 112*a* to a second end 112*b* of the horn 110. The fins increase the bandwidth of the horn antenna 100 by lowering its cutoff frequency.

In some examples, the inner surface 110*a* of the horn 100 defines parallel slots or grooves (not shown) positioned throughout the inner surface 110*a* of the horn 100 and perpendicular to the center axis 111. Such corrugated horn antennas 100 are mainly used as a feed horn for satellite dishes and radio telescopes.

Figure 1B:
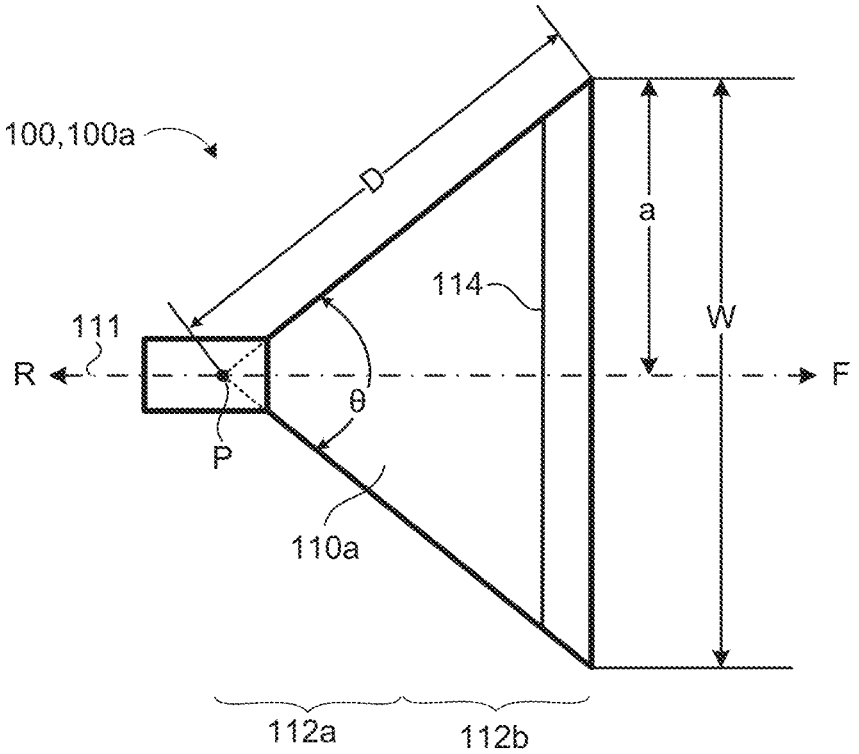
FIG. 1B is a sectional view of the exemplary horn antenna of FIG. 1A
Figure 1C:
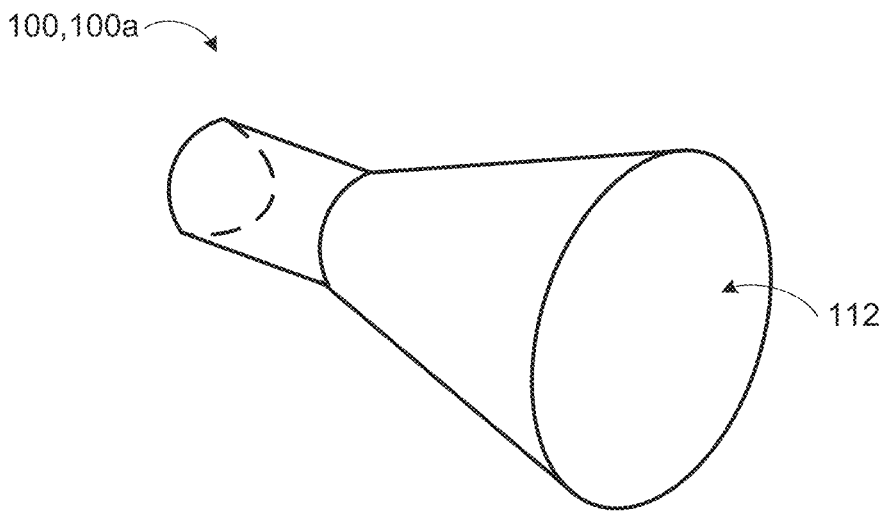
FIGS. 1C and 1D are schematic views of the exemplary horn antenna of FIG. 1A.
Figure 1D:
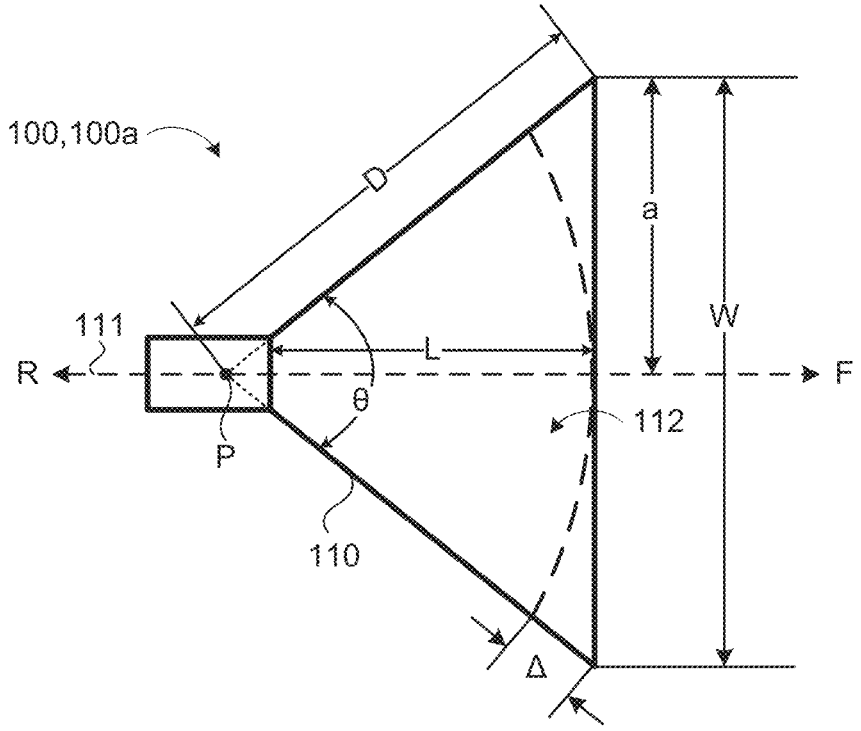
Figure 1E:
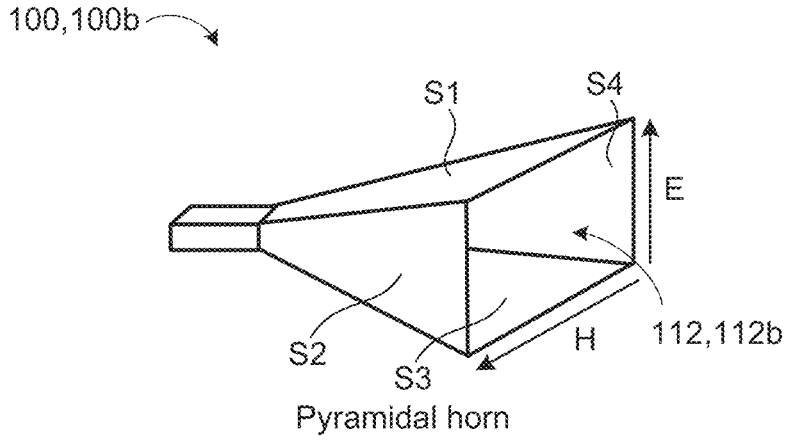
FIG. 1E is a schematic view of an exemplary pyramidal horn antenna.
Figure 1F:
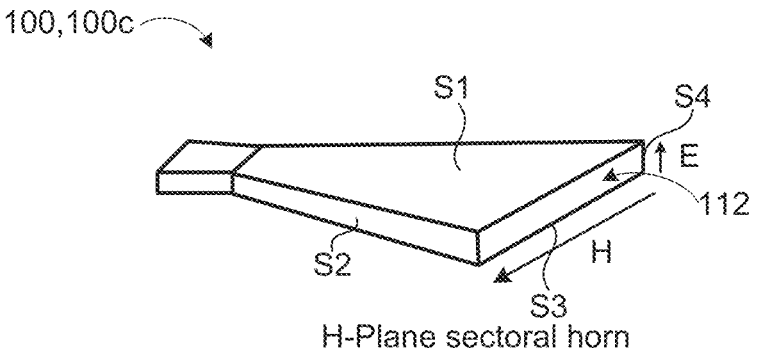
FIG. 1F is a schematic view of an exemplary H-plane horn antenna.
Figure 1G:
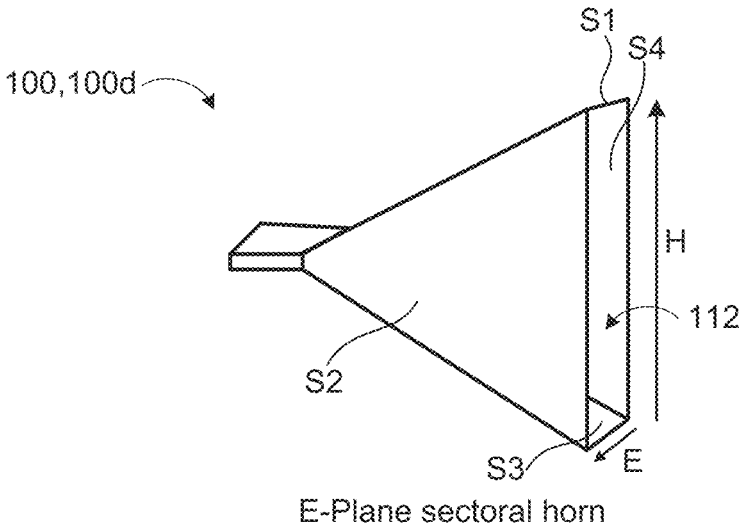
FIG. 1G is schematic view of an exemplary E-plane horn antenna.

Referring to FIGS. 1B and 1D, a distance D extends from the junction P of the projected sides of the horn 100 to the aperture 112. As shown, an additional distance Δ is the extra distance on the sides of the horn 110 compared with the distance to the center of the aperture 112. The extra distance may be determined by $$\Delta = D - \sqrt{D^2 - a^2} \tag{1}$$

where a equals half the width W of the horn 110 (a=W/2).

In some examples, the second end 112*b* of the horn 110 may define a groove 114 configured to receive a lens 200. The groove 114 may be perpendicular to the center axis 111 and extending throughout the inner surface 110*a* of the horn 110. The lens 200 may be releasably removed from the groove 114. In other examples, an adhesive is applied to the edges of the lens 200 (or the inner surface 110*a*) allowing the lens 200 to adhere to the inner surface 110*a* of the second end 112*b* of the horn 110. Other methods ol securing the lens 200 within the horn 110 may also be used.

The horn antenna 100 focuses or concentrates power by strengthening the power of signals in one direction and reducing the power in another direction. For example, the horn antenna 100 strengthens the power of signals exiting the aperture 112 of the horn antenna 100 in a forward direction F and weakens signals received by the aperture 112 of the horn antenna 100 in a rearward direction R.

The dimensions of the horn antenna 100 directly affect the gain G of the horn antenna 100. Horn antenna gain or power gain G is a relative value of an antenna's ability to direct or focus radio frequency energy in the forward direction F or backward direction B. The gain G is measured in decibels relative to an isotropic radiator (dBi) or Decibels relative to a dipole radiator (dBr). The isotropic radiator is the reference point P (apax) that radiates energy equally (equal power) in all directions.

When configuring the wide-band horn antenna 100 to fit within a desired volume, the axial length L of the horn 110 chosen may affect an aperture efficiency of the aperture 112. For example, shortening the axial length L of the horn 110 by increasing the flare angle θ, introduces phase error to the horn aperture 112 (e.g., spherical wave propagation), which affects the gain G. An increase of the flare angle θ to 45 degrees may reduce the axial length of the horn 110 to a minimal practical length D/2 (e.g., 87.5 mm), which increased phase error. Phase error occurs due to the difference between the slant length D of the horn 110 and the axial length L. The phase error at the horn aperture 112 translates directly to degraded aperture efficiency, reducing the gain G of the horn antenna 100.

To mitigate and/or compensate for the phase error, the horn antenna 100 includes a lens 200 (e.g., made of a dielectric material) at the horn aperture 112 where the lens 200 compensates and equalizes the phase distribution over the aperture 112. The lens 200 compensates and/or equalizes the phase distribution over the aperture 112. In other words, the lens 200 corrects phase aberrations that may occur when reducing the axial length L of the horn 110 in an attempt to achieve a constant phase distribution over the aperture for a much shorter horn length L. The larger the flare angle θ of the horn 110, the more correction may be needed up to a maximum flare angle θ (e.g., a 45 degree flare). Moreover, a dielectric lens 200, by virtue of the dielectric material, causes a signal wave propagating towards an entrance plane of the dielectric lens 200 to have a discontinuity in its propagation. The discontinuity is due to some portion of the signal wave reflecting back and some portion of the signal wave transmitting through the dielectric lens 200, resulting in reflection losses and impairing aperture efficiency. The lens 200 may have a maximum thickness T at and measured along the center axis 111 of the horn 110. The thickness of the lens 200 may be tuned to achieve certain downlink and uplink performance of the antenna 100.

Referring to FIGS. 2A-2D, to eliminate the signal reflections, the horn antenna 100 includes the anti-reflection layer 210 disposed on or adjacent the dielectric lens 200. The lens 200 has a first surface 202 and a second surface 204. When the lens 200 is positioned within the aperture 112 of the horn 100, the first surface 202 faces inward toward the receiver 120. The second surface 204 is opposite the first surface 202 and faces outward away from the horn 110. The anti-reflection layer 210 may be made of a dielectric material and is disposed on the first surface 202 of the lens 200. The anti-reflective layer 210 may be part of the lens 200 or integral with the lens 200, i.e., the same contiguous material as the lens 200. By placing the anti-reflection layer 210 on the first surface 202 of the lens 200 that faces the receiver 120, the anti-reflection layer 210 reduces or eliminates the phase error that occurs due to use of the lens 200.

The anti-reflective layer 210 defines a plurality of holes 220. The holes 220 may envelop about 50% (by volume) of the surface of the lens 200. In some examples, the holes 220 are of equal size and shape (as shown in FIGS, 2A-2E). While in other examples, the holes 220 have different sizes and/or a different shape while maintaining 50% of the matter. The holes 220 may define a square, rectangular, polygonal, circular, or elliptical cross-sectional shape. Other shapes are possible as well. The holes 220 are arranged to mitigate and compensate for phase error by equalizing the phase distribution over the aperture 112. In some examples, the holes 220 may have different cross-sectional shapes while maintaining the 50% ratio. The holes 220 may be arranged in a random or ordered manner. The holes 220 are used to counter the reflections caused by the lens 200. In addition, the holes 220 allow the horn 110 to receive or output most of the signals, i.e., the signals are not reflected by the lens 200, instead they are absorbed (in either forward direction F or backward direction B).

The anti-reflective layer 210 defines holes 220 versus grooves or other elongated indentations or voids to provide a relatively even disbursement of the material-to-void ratio (e.g., 50/50). Grooves or elongated voids (e.g., slots having a length of at least 3 or more times a width) result in comparatively degraded performance, due to the lack of a relatively even disbursement of the material-to-void ratio. As discussed below, the use of holes 220, as described herein, improves the downlink performance by 90% or up to 92% and the uplink performance by 80% or up to 90%, and are therefore not a mere design choice.

Figure 2A:
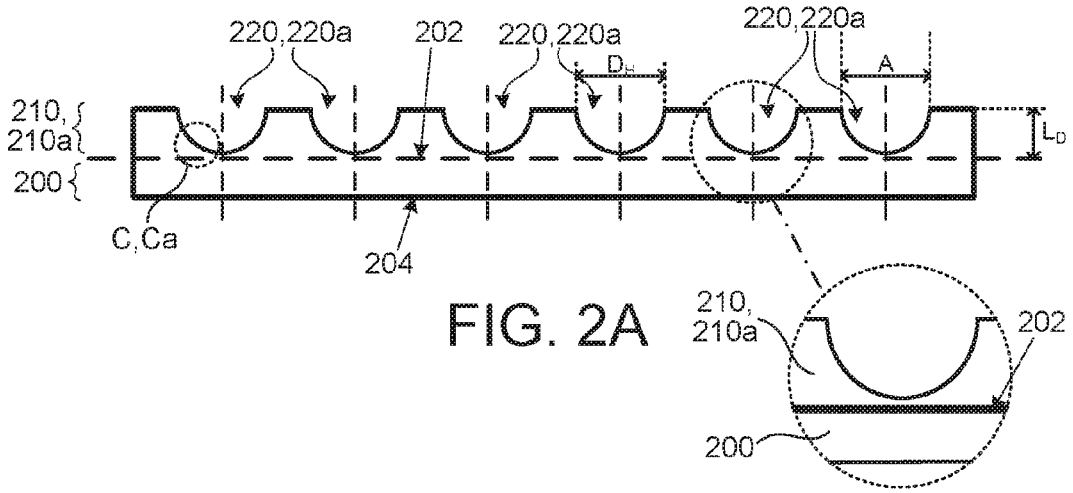
FIGS. 2A, 2B, and 2C are side views of an exemplary anti-reflection layer disposed on a lens.
Figure 2B:
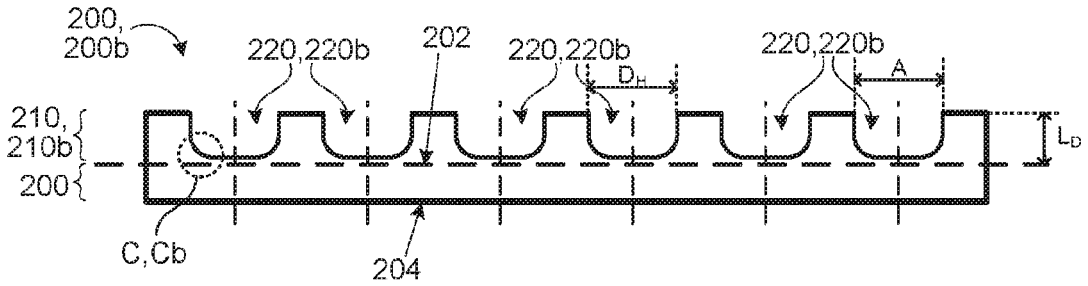
Figure 2C:
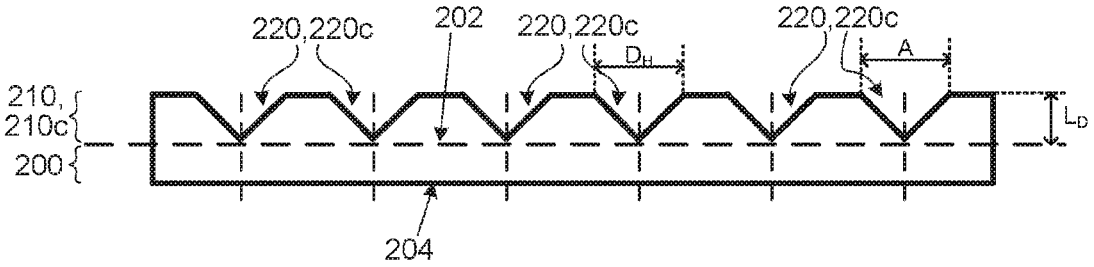
Figure 2D:
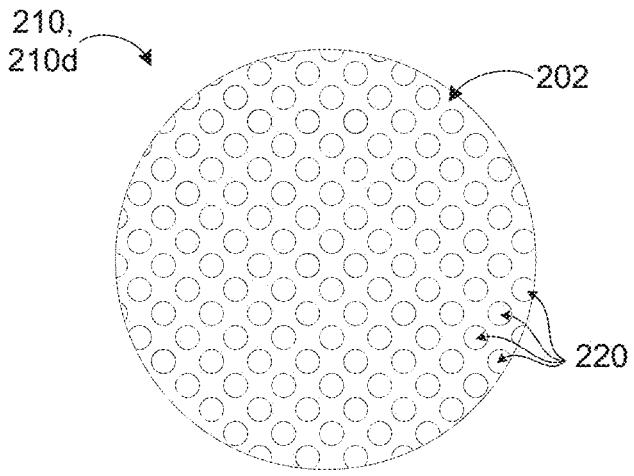
FIGS. 2D and 2E are top views of exemplary anti-reflection layers.
Figure 2E:
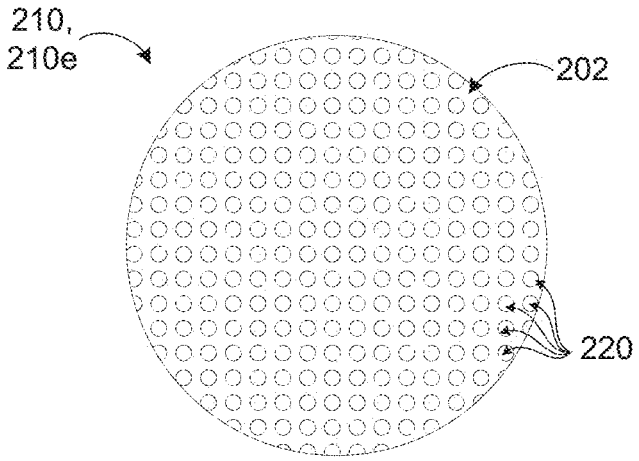

As shown in FIGS. 2A-2C, each hole 220 has a cross-sectional area A and a depth $L_D$. The cross-sectional area A of each hole 220 within an anti-reflection layer 210 may be equal. However, in some examples, the cross-sectional area A of at least some holes 220 within an anti-reflection layer 210 may vary. For example, the cross-sectional area A of a first hole 220 may not be equal to the cross-sectional area A of a second hole 220. In some examples, when the cross-sectional area A of one hole 220 is different than the cross-sectional area A of another hole 220 within the anti-reflection layer 210, the depth $L_D$ of each hole 220 may also vary. In some examples, the depth $L_D$ may be different between holes 220 within the same anti-reflection layer, even though the cross-sectional area A is equal.

FIGS. 2A-2C show different cross-sectional views of an anti-reflection layer 210 disposed on the first surface 202 (surface facing the receiver 120) of a lens 200. Referring to FIG. 2A, the anti-reflection layer 210*a* includes multiple circular holes 220*a*. Each hole 220*a* has a U-shape cross-section defining a first hole curvature Ca. Similarly, FIG. 2B shows an anti-reflection layer 210*b* that includes multiple holes 220*b* that also have a U-shape cross-section. In this example, the anti-reflection layer 210*b* defines a second hole curvature Cb. The first hole curvature Ca of the anti-reflection layer 210*a* of FIG. 2B is less than the second hole curvature Cb of the anti-reflection layer 210*b* of FIG. 2B. Therefore, different hole curvatures C may be used. Referring to FIG. 2C, the anti-reflection layer 210*c* includes holes 220*c* have triangular cross-sectional shapes (e.g., conical, pyramidal, or other shapes). Moreover, the anti-reflective layer 210 may be designed to fit various frequencies by controlling the cross-sectional area A (e.g., diameter) and depth $L_D$ (or thickness) of the holes 220.

The anti-reflection layer 210 may be a quarter wave impedance transformer. A quarter wave impedance transformer (λ/4) is a waveguide component that is one-quarter of a wavelength long and terminates at a known impedance. The anti-reflection layer 210 has a dielectric constant (i.e., relative permittivity) $\in_T$ that may be the geometrical average of the medium prior to a point of reflection (i.e., of the material preceding the lens 200 inside the horn 110) and the medium past the point of reflection (i.e., of the material of the lens 200). In this case:

$$\in_T = \sqrt{\in_{r(Air)} * \in_{r(DialectricMaterial)}} \tag{2}$$

where $\in_T$ is the dielectric constant of the anti-reflection layer 210, $\in_{r(Air)}$ is the dielectric constant (i.e., relative permittivity) of the air inside the horn 110, and $\in_{r(Dialectric_Material)}$ is the dielectric constant (i.e., relative permittivity) of the dielectric material of the lens 200. The dielectric constant of air $\in_{r(Air)}$ is taken into consideration when determining the dielectric constant $\in_T$ of the anti-reflection layer 210, since the holes 220 of the anti-reflection layer 210 are arranged in a 50/50 material to void (i.e., air) ratio (by volume).

The thickness $L_D$ [mm] of the anti-reflection layer 210 may be determined using the following equations:

$$L_D = \frac{\lambda}{4 \cdot \sqrt{\varepsilon_T}} \tag{3}$$

which is a Quarter wave in matter. When the anti-reflection layer 210 is formed integral with the lens 200 (e.g., via molding), the holes 220 have a depth of the thickness $L_D$ of the anti-reflection layer 210 in the first surface 202 of the lens 200. Moreover, the holes 220 may have a diameter $D_H$ (FIGS. 2A-2C) of less than or equal to 0.1λ, while being arranged with a 50/50 material-to-air ratio (by volume).

In some examples, the lens 200 defines a two-dimensional array or grid of holes 220 having a substantially square cross-sectional shape or a substantially circular cross-sectional shape (as shown in FIGS. 2A. and 2B). FIG. 2A shows a diagonal grid, while FIG. 2B shows a parallel grid. Other patterns are possible as well, such as a spiral arrangement, random, and others.

The holes 220 within the anti-reflection layer 210 provide a low cost horn antenna 100 with an improved efficiency for uplink and down links. For example, the addition of the lens 200 with the anti-reflection layer 210 allows for a shorter axial length L of the horn 110.

Figure 3:
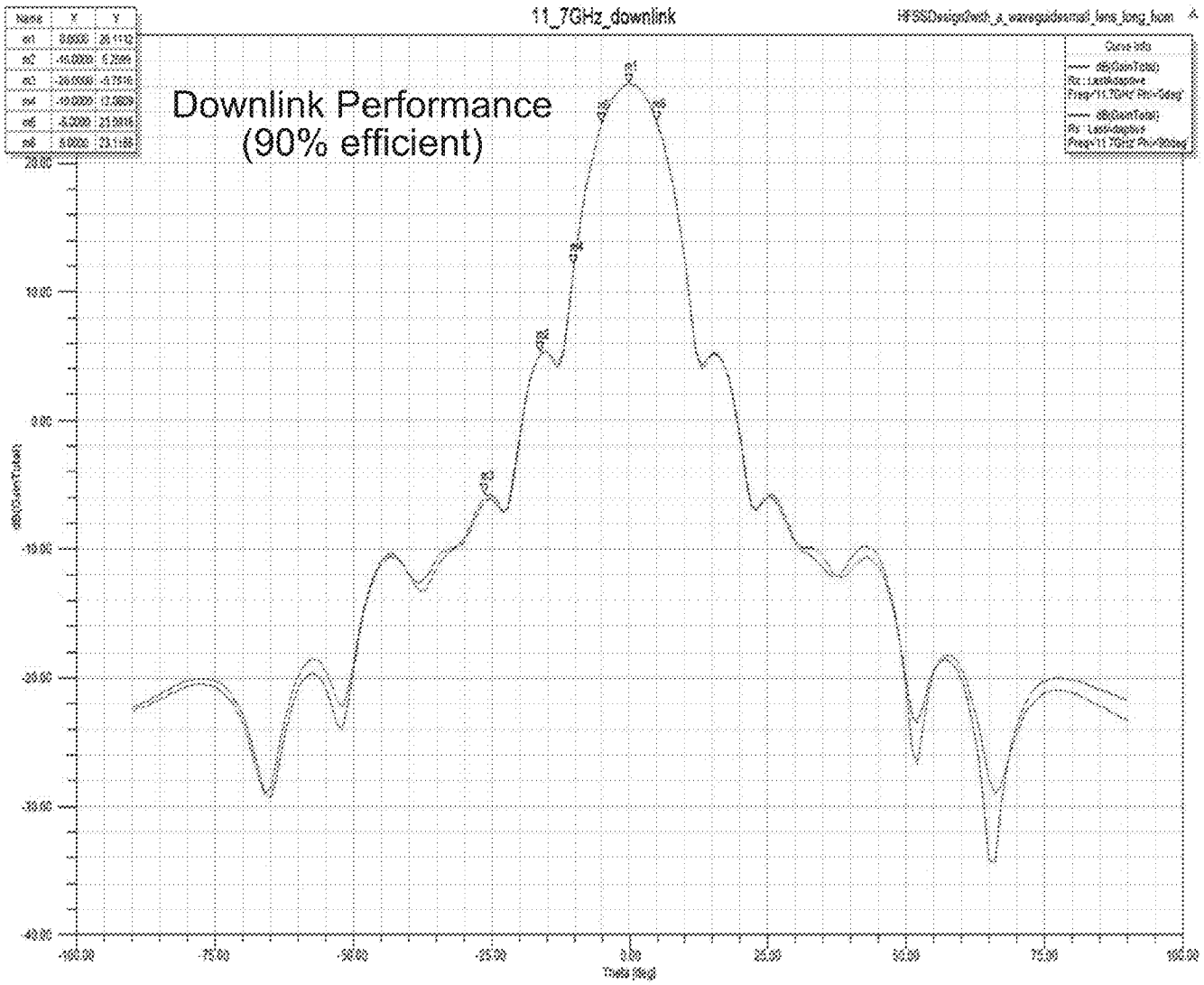
FIG. 3 is a schematic view of the uplink performance of an exemplary lens horn antenna.
Figure 4:
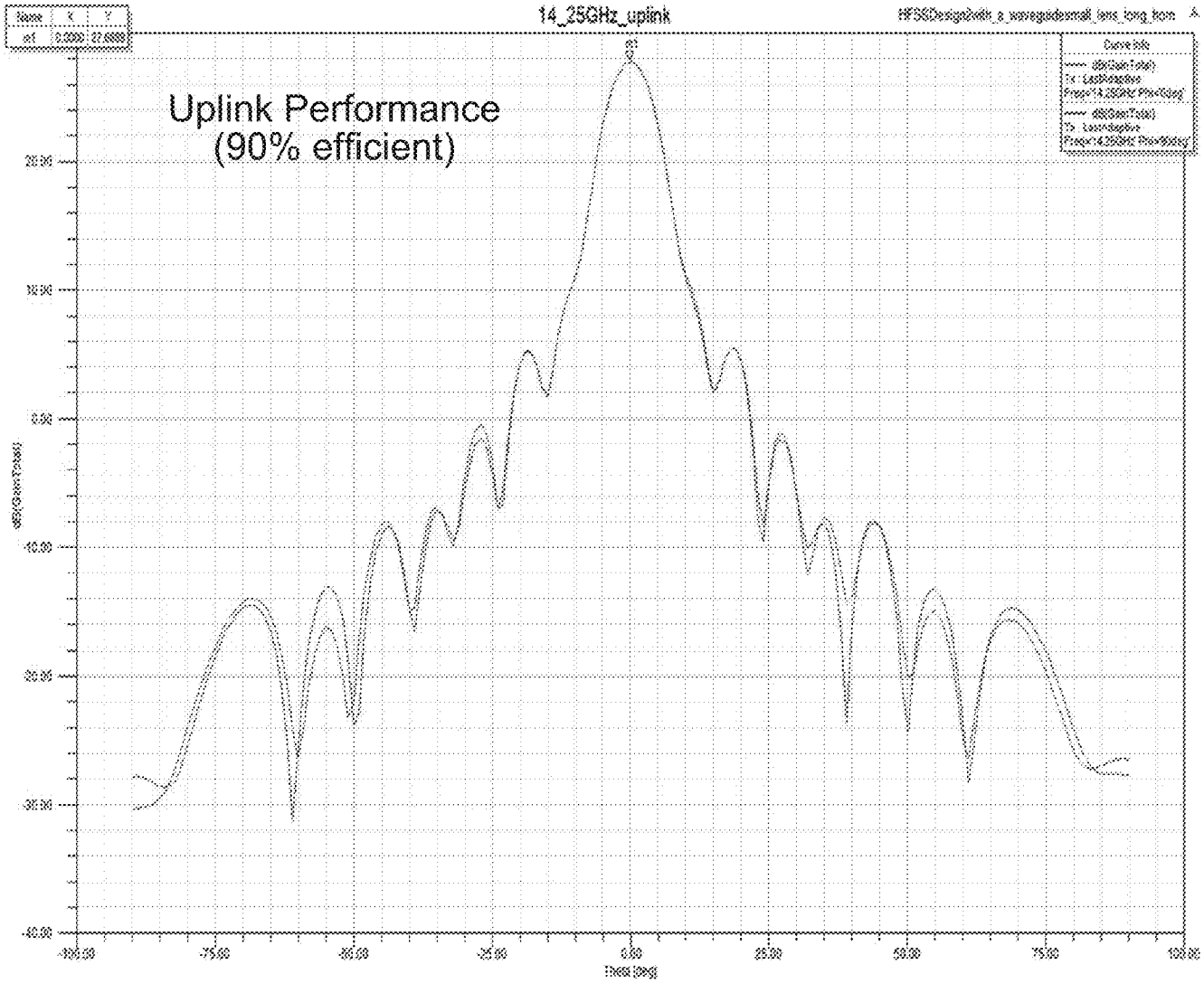
FIG. 4 is a schematic view of the downlink performance of an exemplary lens horn antenna.

Referring to FIGS. 3 and 4, the horn antenna 100 improves the downlink performance by 90% or up to 92% (FIG. 3) and the uplink performance by 80% or up to 90% (FIG. 4). For example, a horn 110 having an axial length L that equals 162 mm, and a dielectric constant $\in_T$ of the anti-reflection layer 210 that equals 2.2, has a gain G equals 26.16 dBi for a downlink frequency of 11.7 GHz, which is 90%) efficient (FIG. 3). The uplink gain G equals 27.36 dBi for an uplink frequency of 14.25 GHz, which is 80% efficient (FIG. 4). In another example, the horn 110 may have an axial length L that equals 360 mm and a T=20 mm (where T is a maximum thickness of the lens 200 along the center axis 111 of the horn 110 (FIG. 1A)), a dielectric constant $\in_T$ of the anti-reflection layer 210 that equals 2.2, and a gain G equals 26.16 dBi for a downlink frequency of 11.7 GHz, which is 92% efficient (FIG. 3). The uplink gain G equals 27.36 dBi for an upload frequency of 14.25 GHz, which is 90% efficient (FIG. 4). Therefore, increasing the axial length L of the horn 110 increases the efficiency of both the uplink and downlink of the horn antenna 100.

In some examples, the lens 200 is a cross linked polysterene microwave plastic. The lens 200 may maintain a dielectric constant of 2.53 through 500 GHz with low dissipation factors. In some examples, the lens 200 may include a Polytetrafluoroethlyene (PTFE), which is a synthetic fluoropolymer of tetrafluoroethlyene. PTFE is a flurocarbon solid with a high-molecular weight compound made of carbon and fluorine. PTFE has a low coefficient of friction against any solid, and is hydrophobic (i.e., repels water).

Figure 5:
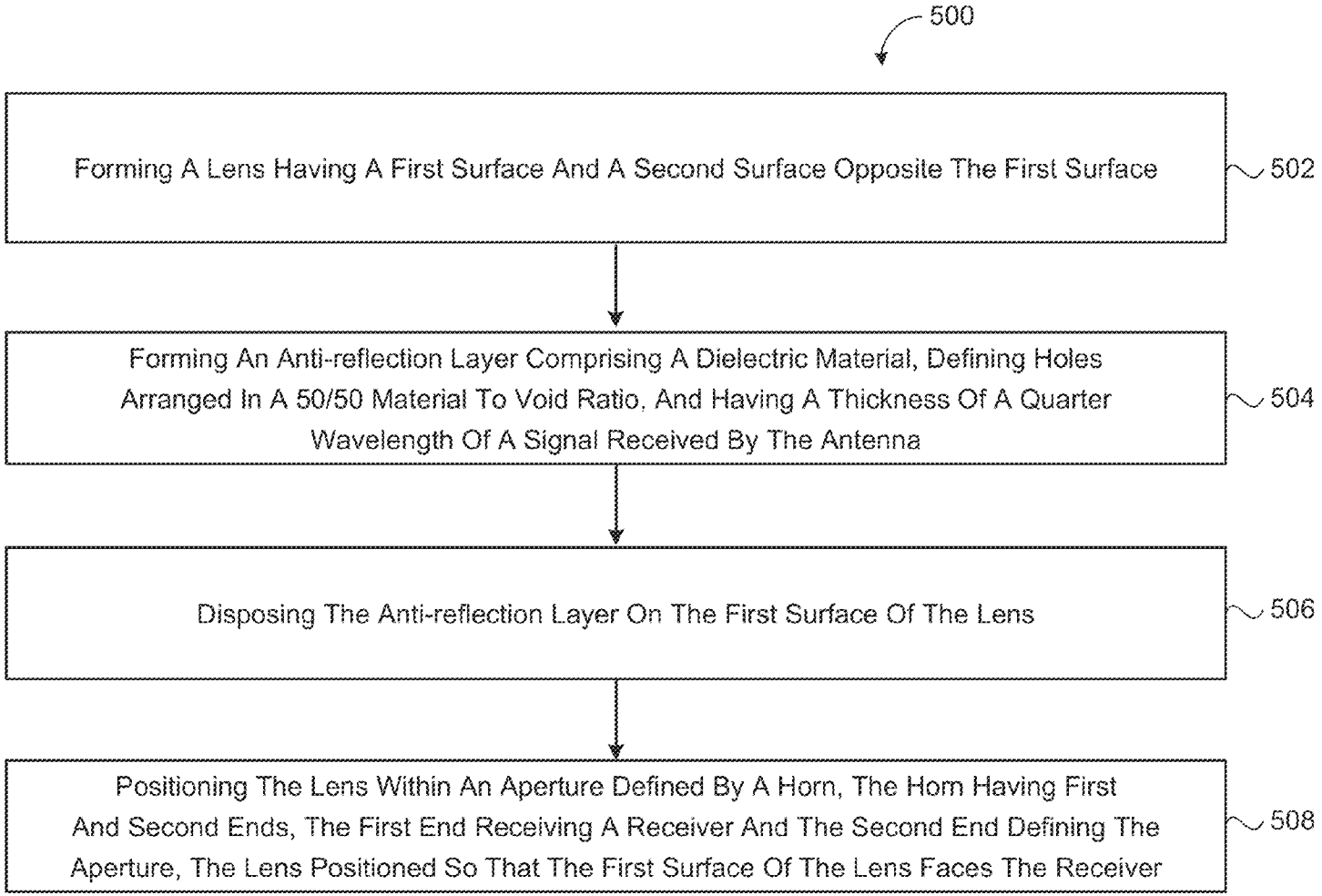
FIG. 5 is a schematic view of an exemplary arrangement of operations for a method of making a horn antenna.

Referring to FIG. 5, in some implementations, a method 500 of making a horn antenna 100, includes: forming 502 a lens 200 having a first surface 202 and a second surface 204 opposite the first surface 202; forming 504 an anti-reflection layer 210 having a dielectric material; disposing 506 the anti-reflection layer 210 on the first surface 202 of the lens 200; and positioning 508 the lens 200 within an aperture 212 defined by a horn 110. The anti-reflection layer 210 defines holes 220 arranged in a 50/50 material to void ratio and has a thickness $L_D$ of a quarter wavelength of a signal received by the horn antenna 100. The horn 110 has first and second ends 112*a*, 112*b*, where the first end 112*a* receives a receiver 120 and the second end 112*b* defines the aperture 112. The lens 200 is positioned so that the first surface 202 of the lens 200 faces the receiver 120. In some examples, the second surface 204 of the lens 200 defines holes, grooves, or indentations as well.

A number of implementations have been described. Nevertheless, it will be understood that various modifications may be made without departing from the spirit and scope of the disclosure. Accordingly, other implementations are within the scope of the following claims.

What is claimed is:

1. An antenna comprising:

a receiver;

a horn having a first end disposed on the receiver and a second end defining an aperture positioned opposite the receiver, the horn defining a slant length and an axial length being half the slant length and having a flare angle of about 45 degrees; and a lens disposed within the aperture of the horn, the lens having a first surface facing inward toward the receiver and a second surface opposite the first surface and facing outward away from the horn;

an anti-reflection layer comprising a dielectric material and disposed on the first surface of the lens, the anti-reflection layer defining holes arranged in a 50/50 material to void ratio and having a thickness of a quarter wavelength of a signal received by the antenna, each hole formed through the thickness of the anti-reflection layer.

2. The antenna of claim 1, wherein the horn defines a frustoconical shape, a pyramidal shape, an h-plane sectoral shape, or an E-shape sectoral shape.

3. The antenna of claim 1, wherein the lens and the anti-reflection layer comprise a cross linked polysterene microwave plastic or a Polytetrafluoroethylene.

4. The antenna of claim 1, wherein the holes have a diameter of less than or equal to a tenth of the wavelength of the signal received by the antenna.

5. The antenna of claim 1, wherein a dielectric constant $\in_T$ of the anti-reflection layer is defined as:

$$\in_T = \sqrt{\in_{r(Air)} * \in_{r(DialectricMaterial)}}$$

wherein $\in_{r(Air)}$ is a dielectric constant of air and $\in_{r(Dialectric\ Material)}$ is a dielectric constant of the dielectric material of the anti-reflection layer.

6. The antenna of claim 1, wherein the holes of the anti-reflection layer have one or more of a circular cross-sectional shape, a square cross-sectional shape, a diamond cross-sectional shape, an oval cross-sectional shape, or a rectangular cross-sectional shape.

7. The antenna of claim 1, wherein the holes are arranged in a two-dimensional array.

8. The antenna of claim 1, wherein the horn defines a frustoconical shape.

9. A method of making a horn antenna, the method comprising:

forming a lens having a first surface and a second surface opposite the first surface;

forming an anti-reflection layer comprising a dielectric material, defining holes arranged in a 50/50 material to void ratio, and having a thickness of a quarter wavelength of a signal received by the antenna, each hole formed through the thickness of the anti-reflection layer;

disposing the anti-reflection layer on the first surface of the lens; and positioning the lens within an aperture defined by a horn, the horn having first and second ends, the first end receiving a receiver and the second end defining the aperture, the horn defining a slant length and an axial length being half the slant length and having a flare angle of about 45 degrees, the lens positioned so that the first surface of the lens faces the receiver.

10. The method of claim 9, wherein the horn defines a frustoconical shape, a pyramidal shape, an h-plane sectoral shape, or an E-shape sectoral shape.

11. The method of claim 9, wherein the lens and the anti-reflection layer comprise a cross linked polysterene microwave plastic or a Polytetrafluoroethylene.

12. The method of claim 9, wherein the holes have a diameter of less than or equal to a tenth of the wavelength of the signal received by the antenna.

13. The method of claim 9, wherein a dielectric constant $\in_T$ of the anti-reflection layer is defined as:

$$\in_T = \sqrt{\in_{r(Air)} * \in_{r(DialectricMaterial)}}$$

wherein $\in_{r(Air)}$ is a dielectric constant of air and $\in_{r(Dialectric\ Material)}$ is a dielectric constant of the dielectric material of the anti-reflection layer.

14. The method of claim 9, wherein the holes of the anti-reflection layer have one or more of a circular cross-sectional shape, a square cross-sectional shape, a diamond cross-sectional shape, an oval cross-sectional shape, or a rectangular cross-sectional shape.

15. The method of claim 9, wherein the holes are arranged in a two dimensional array.

16. The method of claim 9, wherein the horn defines a frustoconical shape.

* * * * *